US005577334A

United States Patent [19]

Park

[11] Patent Number: 5,577,334

[45] Date of Patent: Nov. 26, 1996

[54] CUSHIONING OUTSOLE

[76] Inventor: Youngsoul Park, Sangil Usong Town 6-301, 174, Sangil-tong, Kangdong-ku, Seoul, Rep. of Korea

[21] Appl. No.: 507,830

[22] Filed: Jul. 27, 1995

[30] Foreign Application Priority Data

Aug. 3, 1994 [KR] Rep. of Korea ..... 94-19738

[51] Int. Cl.[6] ..... A43B 13/18; A43B 21/26

[52] U.S. Cl. ..... 36/28; 36/35 R

[58] Field of Search ..... 36/28, 27, 35 R, 36/38

[56] References Cited

U.S. PATENT DOCUMENTS

| | | | |
|---|---|---|---|
| 4,445,284 | 5/1984 | Sakutori | 36/28 X |
| 4,753,021 | 6/1988 | Cohen | 36/28 X |
| 4,881,329 | 11/1989 | Crowley | 36/27 X |
| 5,138,776 | 8/1992 | Levin | 36/27 X |
| 5,212,878 | 5/1993 | Burke et al. | 36/28 X |
| 5,461,800 | 10/1995 | Luthi et al. | 36/28 |

FOREIGN PATENT DOCUMENTS

| | | | |
|---|---|---|---|
| 958766 | 3/1950 | France | 36/28 |

*Primary Examiner*—Ted Kavanaugh

*Attorney, Agent, or Firm*—Whitham, Curtis, Whitham & McGinn

[57] ABSTRACT

An outsole of a shoe including a plurality of throughout hole formed at its heel portion, its middle portion and its toe portion, thereby achieving lightness of the shoe and improvement in cushion effect. A pressing protrusion which is formed at the middle portion of the outsole by the throughout hole provided at the middle portion of the outsole contacts frictionally the concave portion of the wearer's foot, thereby providing the foot-pressing effect for health. The throughout hole provided at the middle portion of the outsole generates an effect of softly massaging the concave portion of the wearer's foot being pressed by the pressing protrusion, by virtue of its air cushion. An inclined surface which is provided at the upper surface of the toe portion of the outsole serves to prevent the feet of the wearer from outwardly diverging in the inverted-V form during walking.

9 Claims, 3 Drawing Sheets

CUSHIONING OUTSOLE

BACKGROUND OF THE INVENTION

1. Field of the Invention

The present invention relates to shoes, and more particularly to an outsole of a shoe having a plurality of throughout holes at heel and toe portions of the shoe.

2. Description of the Prior Art

It is well-known that shoes have a construction capable of protecting feet of a wearer and absorbing grounding impact transmitted to the feet during his walking. For obtaining a cushion, conventional outsoles are made of a sponge material. However, such outsoles made of the sponge material are easily deformed by pressure repeatedly or continuously applied thereto.

For solving such a problem, there has been used outsoles made of a material exhibiting a superior strength and a superior elasticity. However, such outsoles have a limited cushion.

Recently, there has been proposed shoes with an outsole structure including cushion means comprising a plurality of air chambers provided at a heel portion of an outsole or a toe portion of the outsole. The air chambers are adapted to be pumped with air when they are pressed during walking of the wearer. Although these shoes exhibit a cushion effect more or less upon being subjected to small impact, their outsoles may be deformed by large impact. In severe cases, the outsoles get squeezed, so that they may exhibit any cushion effect no longer. Due to the provision of the air chambers, the manufacture of shoes is complex, thereby increasing the cost of shoes.

SUMMARY OF THE INVENTION

Therefore, an object of the invention is to solve the above-mentioned problems encountered in the prior art and, thus, to provide a shoe having an outsole structure capable of reducing the weight, simplifying the manufacture, exhibiting a superior impact-adsorbing effect against a large impact, accurately pressing the bottom of foot during walking, and preventing the feet of the wearer from outwardly diverging in the inverted-V form during walking.

In accordance with the present invention, this object can be accomplished by providing an outsole of a shoe, comprising cushion means comprised of a large throughout hole provided at a heel portion of the outsole, and a plurality of laterally extending small throughout holes provided at a toe portion of the outsole, the outsole further comprising: a curved portion provided at a middle portion of the outsole and shaped to conform to a concave portion of a wearer's foot; a pressing protrusion formed along the curved portion; a throughout hole extending laterally through the pressing protrusion and having a cross-section gradually increased as it extends laterally from an outer side face of the outsole to an inner side face of the outsole; an inclined surface provided at the toe portion of the outsole and downwardly inclined as it extends from the outer side face of the outsole to the inner side face of the outsole.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
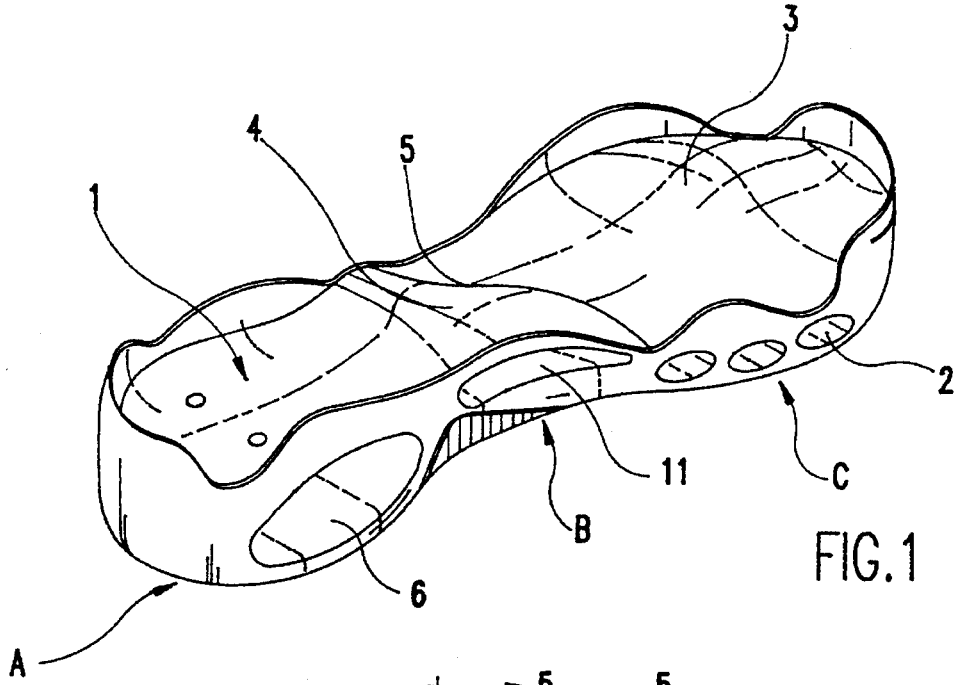
FIG. 1 is a perspective view of an outsole of a shoe in accordance with an embodiment of the present invention.
Figure 2:
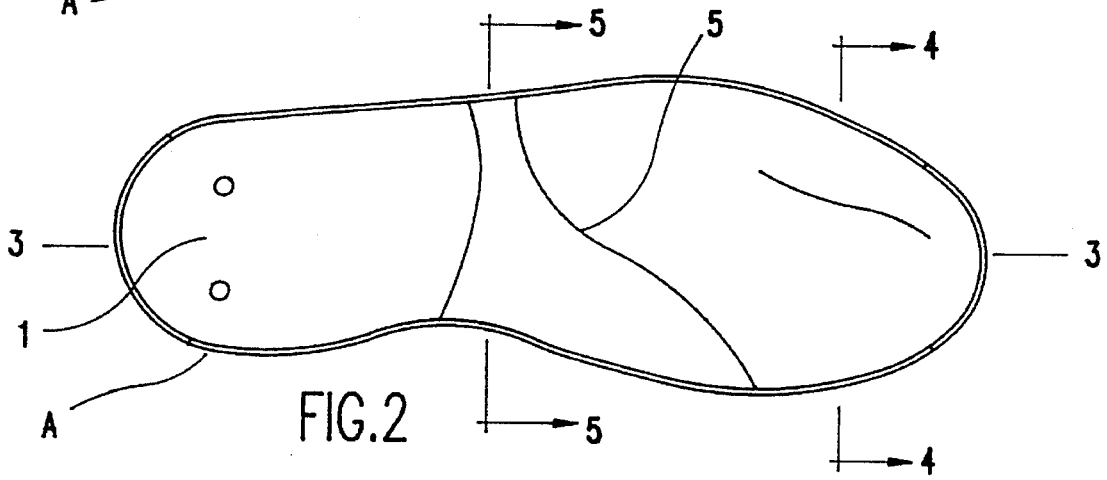
FIG. 2 is a plan view of the outsole shown in FIG. 1.
Figure 3:
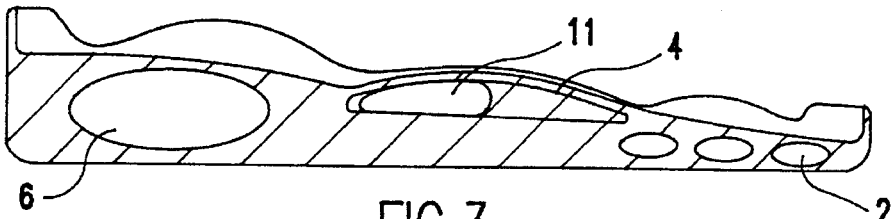
FIG. 3 is a cross-sectional view taken along the line A—A of FIG. 2.
Figure 4:
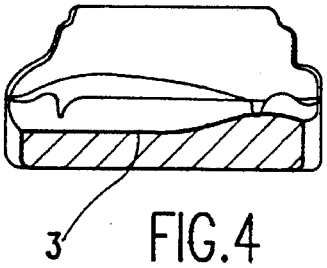
FIG. 4 is a cross-sectional view taken along the line B—B of FIG. 2.
Figure 5:
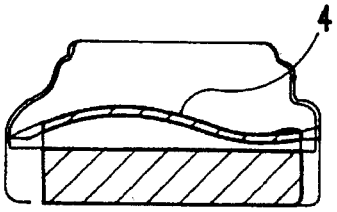
FIG. 5 is a cross-sectional view taken along the line C—C of FIG. 2.

FIG. 1 is a perspective view of an outsole of a shoe in accordance with an embodiment of the present invention.

As shown in FIG. 1, the outsole includes cushion means 1 provided at a heel portion A of the outsole. In the embodiment illustrated in FIG. 1, the cushion means 1 comprises a large throughout hole 6 formed at the whole part of the heel portion A. The throughout hole 6 extends laterally.

Figure 6:
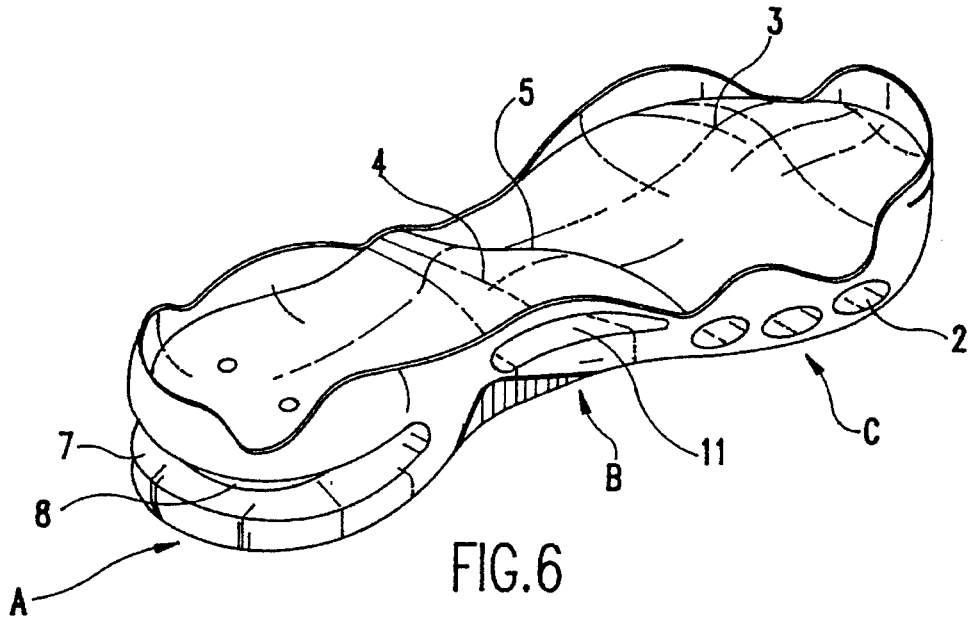
FIG. 6 is a perspective view of an outsole in accordance with another embodiment of the present invention.
Figure 7:
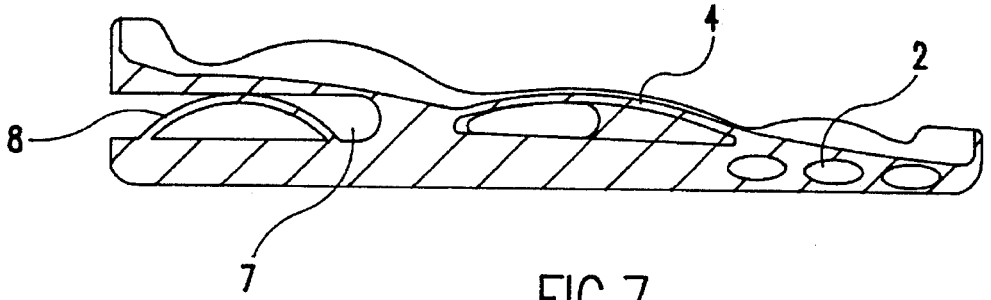
FIG. 7 is a sectional view of the outsole shown in FIG. 6.
Figure 8:
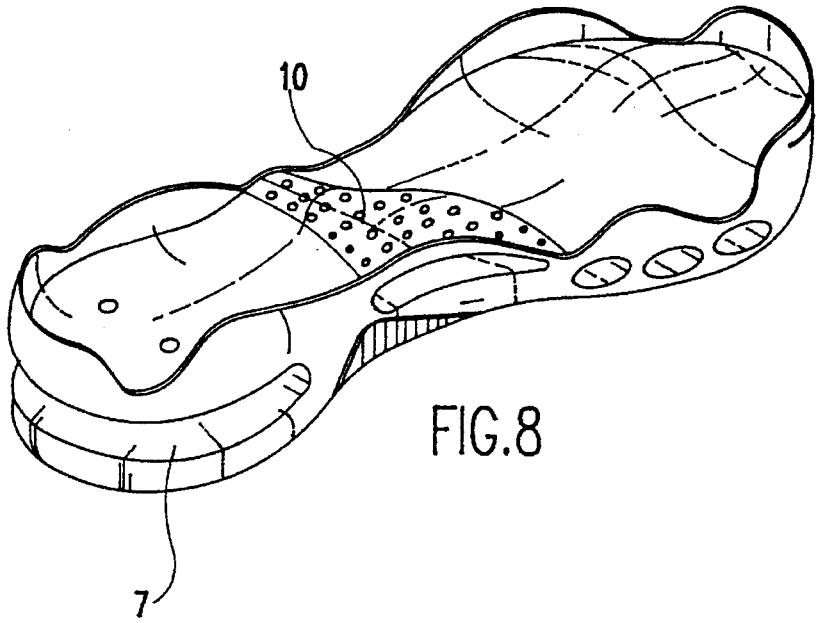
FIG. 8 is a perspective view of an outsole in accordance with another embodiment of the present invention.
Figure 9:
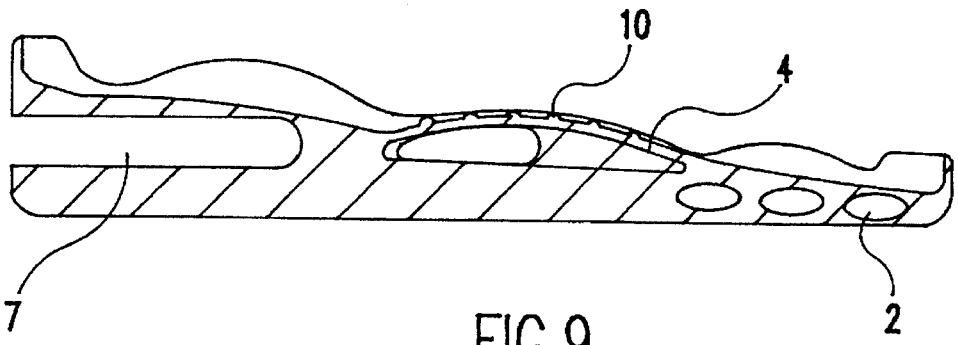
FIG. 9 is a sectional view of the outsole shown in FIG. 8.

The cushion means 1 may comprise an opening 7 opened at three faces, namely, the rear face and the opposite side faces of the heel portion A, as shown in FIG. 8. In this case, a hollow cushion protrusion 8 may be provided at the central portion of the opening 7, as shown in FIGS. 6 and 7. The cushion protrusion 8 is made of a material exhibiting a superior impact-absorbing effect. Although the cushion protrusion 8 has an arc shape in the illustrated case, it may have any other shape capable of improving the cushion effect.

Figure 10:
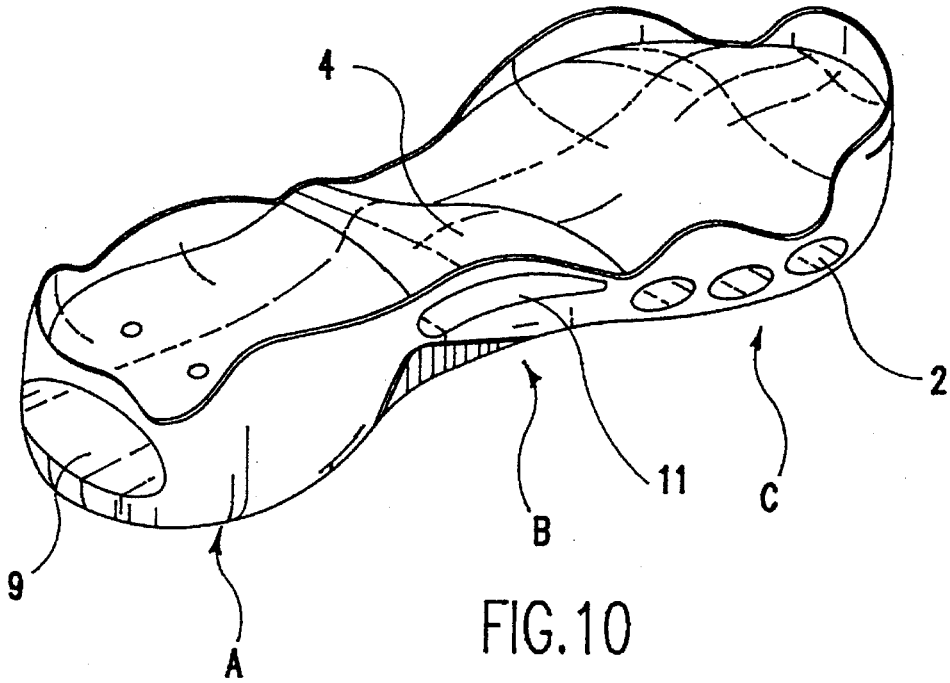
FIG. 10 is a perspective view of an outsole in accordance with another embodiment of the present invention.
Figure 11:
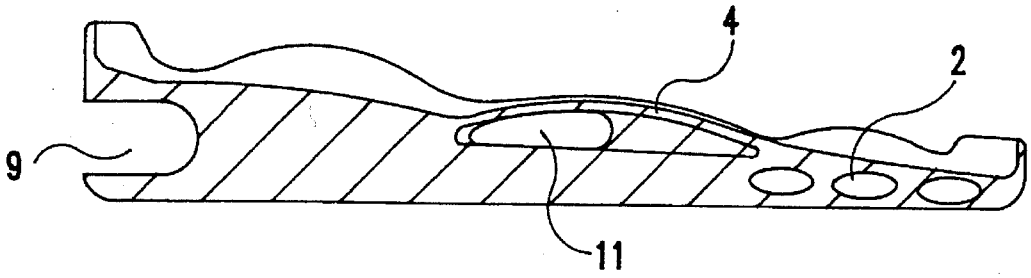
FIG. 11 is a sectional view of the outsole shown in FIG. 10.

Alternatively, the cushion means 1 may comprise a recess 9 opened at the rear face of the heel portion A, as shown in FIG. 10. Since the heel portion A is opened at its rear face in this case, it is required to be made of a material capable of hardly generating a deformation caused by pressure repeatedly applied under a condition that there is no instantaneous impact. Of course, other appropriate materials may be selected in accordance with the using purpose.

The outsole also includes a pressing protrusion 4 provided at a middle portion B of the outsole. The pressing protrusion 4 has a curved portion 5 shaped to conform to the concave portion of the wearer's foot. Through the pressing protrusion 4, a throughout hole 11 extends laterally. The throughout hole 6 has a cross-section gradually increased as it extends laterally from the outer side face to the inner side face.

A plurality of small lugs 10 may be provided at the upper surface of the pressing protrusion 4, as shown in FIG. 8. In this case, the foot-pressing effect is enhanced. The throughout hole 11 provides an air cushion and thereby generates an effect of softly massaging the concave portion of the wearer's foot being pressed by the pressing protrusion 4.

The outsole further includes several small throughout holes 2 provided at a toe portion C of the outsole. The small throughout holes 2 extend laterally.

A filler exhibiting a superior impact-absorbing effect may be filled in the throughout holes 2 and/or the throughout hole 6.

The throughout hole 6 may have any shape, for example, a circular shape or an oval shape. Where the throughout hole 6 has the circular shape, the outsole has an advantage of a decrease in thickness.

In accordance with the present invention, the toe portion C of the outsole has an inclined surface 3 which is downwardly inclined as it extends from the outer side face to the inner side face.

Since the outsole includes the cushion means 1 constituted by the large throughout hole 6 formed at the whole part of the heel portion A, lightness of shoes can be achieved. Since the pressing protrusion 4 formed along the curved portion 5 at the middle portion B of the outsole contacts frictionally the concave portion of the wearer's foot, it exhibits the foot-pressing effect for health (it is known in Chinese medicine that a healthy physical constitution is obtained by always pressing the concave portion of foot on which all functions of the body concentrate). Moreover, the throughout hole 11 generates an effect of softly massaging the concave portion of the wearer's foot being pressed by the pressing protrusion 4, by virtue of its air cushion. Since the outsole has the inclined surface 3 provided at the upper surface of the toe portion C, it is possible to prevent the feet of the wearer from outwardly diverging in the inverted-V form during walking.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An outsole of a shoe, comprising cushion means comprised of a large throughout hole provided at a heel portion of the outsole, and a plurality of laterally extending small throughout holes provided at a toe portion of the outsole, the outsole further comprising:

a curved portion provided at a middle portion of the outsole and shaped to conform to a concave portion of a wearer's foot;

a pressing protrusion formed along the curved portion;

a throughout hole extending laterally through the pressing protrusion and having a cross-section gradually increased as it extends laterally from an outer side face of the outsole to an inner side face of the outsole;

an inclined surface provided at the toe portion of the outsole and downwardly inclined as it extends from the outer side face of the outsole to the inner side face of the outsole.

2. The outsole as recited in claim 1, wherein said cushion means comprises a large throughout hole formed over substantially the entire heel portion of the outsole.

3. The outsole as recited in claim 2, wherein said large throughout hole provided in said heel portion of said outsole extends laterally through said outsole.

4. The outsole as recited in claim 1, wherein said cushion means comprises an opening at three faces of the heel portion of said outsole.

5. The outsole as recited in claim 4, wherein a cushion protrusion is provided at a lower portion of said opening at the heel portion of said outsole.

6. The outsole as recited in claim 5, wherein said cushion protrusion is provided in an arc shape.

7. The outsole as recited in claim 1, wherein said cushion means comprises a recess opened at a rear face of the heel portion of said outsole.

8. The outsole as recited in claim 1, wherein an upper surface of said pressing protrusion is provided with a plurality of small lugs.

9. The outsole as recited in claim 1, wherein said large throughout hole provided in said heel portion of said outsole extends laterally through said outsole.

* * * * *